US008626022B2

(12) United States Patent
Nagao

(10) Patent No.: US 8,626,022 B2
(45) Date of Patent: Jan. 7, 2014

(54) IMAGE FORMING APPARATUS HAVING OVERTURNING PREVENTION PARTS

(75) Inventor: Tomotaka Nagao, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 306 days.

(21) Appl. No.: 13/094,508

(22) Filed: Apr. 26, 2011

(65) Prior Publication Data

US 2012/0099889 A1 Apr. 26, 2012

(30) Foreign Application Priority Data

Oct. 22, 2010 (JP) ..... 2010-237318

(51) Int. Cl.
*G03G 15/00* (2006.01)

(52) U.S. Cl.
USPC ..... 399/107; 399/125

(58) Field of Classification Search
USPC ..... 399/107, 125
See application file for complete search history.

(56) References Cited

U.S. PATENT DOCUMENTS

| | | | | |
|---|---|---|---|---|
| 4,789,876 | A * | 12/1988 | Miyai et al. | 399/108 |
| 5,689,775 | A * | 11/1997 | Marumoto | 399/121 |
| 6,741,820 | B2 * | 5/2004 | Nobe et al. | 399/110 |
| 7,489,888 | B2 * | 2/2009 | Sato et al. | 399/111 |
| 2002/0114640 | A1 * | 8/2002 | Nobe et al. | 399/110 |
| 2008/0267659 | A1 * | 10/2008 | Koyama | 399/107 |
| 2013/0195503 | A1 * | 8/2013 | Nakagaki | 399/107 |

FOREIGN PATENT DOCUMENTS

JP 2004-272081 A 9/2004

* cited by examiner

*Primary Examiner* — G. M. Hyder
(74) *Attorney, Agent, or Firm* — Sughrue Mion, PLLC

(57) ABSTRACT

An image forming apparatus includes: an image forming apparatus main body; an image forming part provided in the image forming apparatus main body, to form an image on a recording medium; an operation part used for operation of the image forming apparatus; a support part provided on a bottom surface of the image forming apparatus main body and in contact with a mounting surface for the image forming apparatus main body to support the image forming apparatus main body; and a convex part provided on the bottom surface, the convex part being provided on the operation part side from the support part, and forming a clearance between the convex part and the mounting surface.

11 Claims, 9 Drawing Sheets

IMAGE FORMING APPARATUS HAVING OVERTURNING PREVENTION PARTS

CROSS-REFERENCE TO RELATED APPLICATION

This application is based on and claims priority under 35 USC 119 from Japanese Patent Application No. 2010-237318 filed Oct. 22, 2010.

BACKGROUND

Technical Field

The present invention relates to an image forming apparatus.

SUMMARY

According to an aspect of the present invention, there is provided an image forming apparatus including: an image forming apparatus main body; an image forming part provided in the image forming apparatus main body, to form an image on a recording medium; an operation part used for operation of the image forming apparatus; a support part provided on a bottom surface of the image forming apparatus main body and in contact with a mounting surface for the image forming apparatus main body to support the image forming apparatus main body; and a convex part provided on the bottom surface, the convex part being provided on the operation part side from the support part, and forming a clearance between the convex part and the mounting surface.

BRIEF DESCRIPTION OF THE DRAWINGS

An exemplary embodiment of the present invention will be described in detail based on the following figures, wherein.

DETAILED DESCRIPTION

Next, an exemplary embodiment of the present invention will be described based on the drawings.

Figure 1:
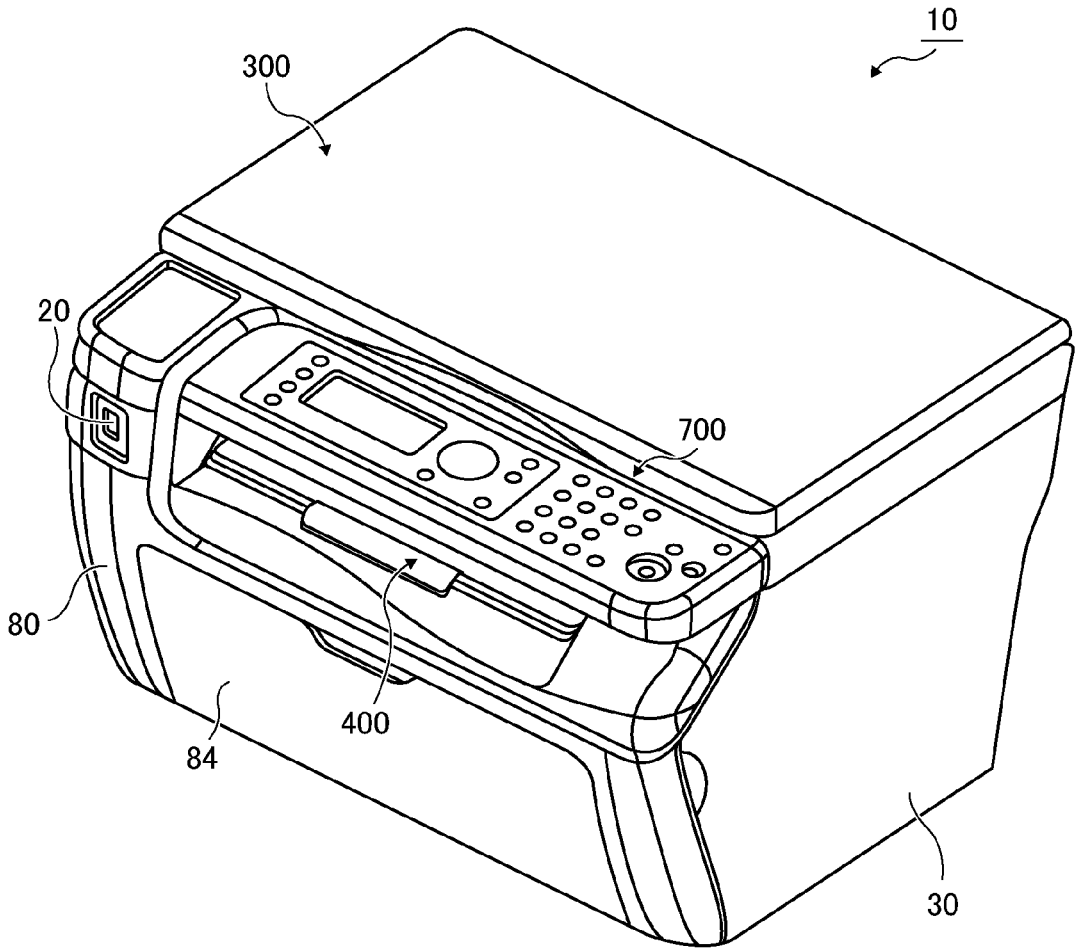
FIG. 1 is a perspective view showing an image forming apparatus according to an exemplary embodiment of the present invention.
Figure 2:
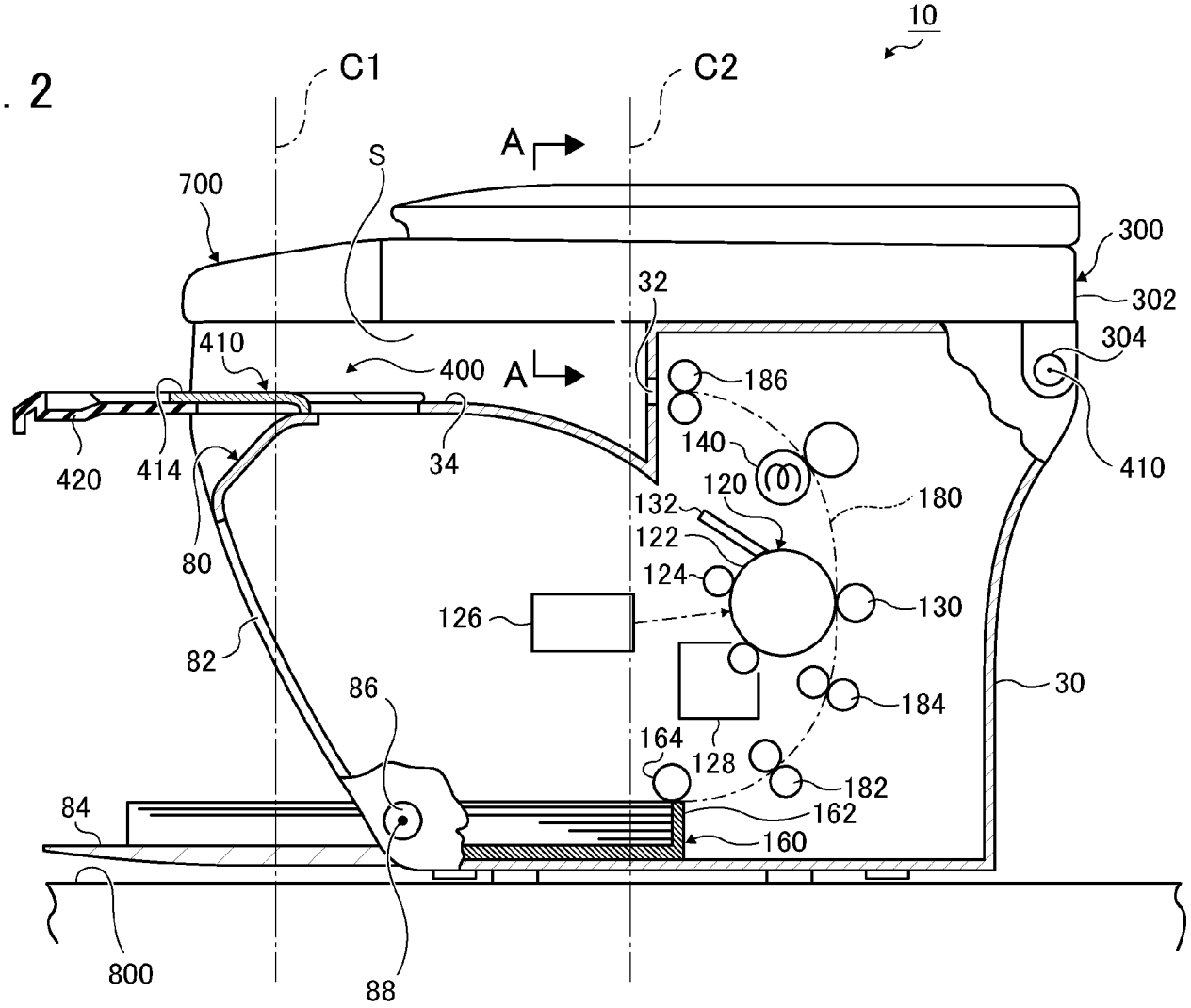
FIG. 2 is a cross-sectional view of the image forming apparatus in FIG. 1 viewed from a right side surface.
Figure 3:
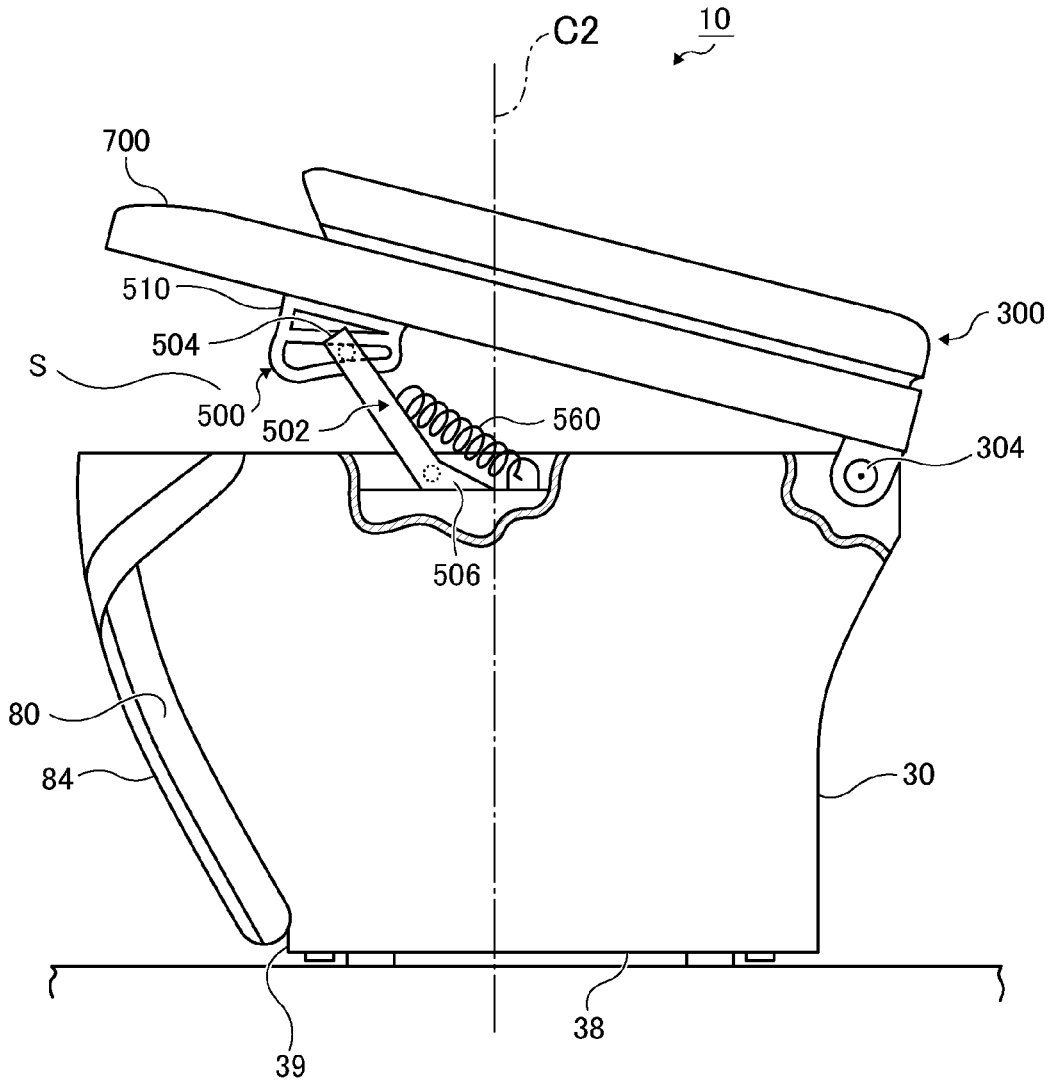
FIG. 3 is a partially cutaway diagram showing the image forming apparatus in FIG. 1 viewed from the right side surface side.

FIG. 1 to FIG. 3 show an image forming apparatus 10 according to an exemplary embodiment of the present invention. The image forming apparatus 10 has an image forming apparatus main body 30. An image forming part 120 to form an image on a print sheet used as a recording medium and a paper feeding device 160 to supply the sheet to the image forming part 120 are provided in in the image forming apparatus main body 30. Further, a conveyance passage 180 is formed in the image forming apparatus main body 30. Further, the image forming apparatus 10 has a document reading device 300 to read a document, a discharge part 400 on which a print sheet on which an image has been formed is discharged, a buffer device 500, an operation panel 700 used as an operation part for operation of the image forming apparatus 10, and a data input terminal 20 to input image data from an external device such as a personal computer.

The image forming apparatus 10 forms an image on a print sheet based on image data read with the document reading device 300, and forms an image on a print sheet based on image data inputted from the data input terminal 20. Further, the image forming apparatus 10, which is connectible to e.g. a telephone line, forms an image on a print sheet based on image data inputted via e.g. a telephone line. Further, the image forming apparatus 10 transmits image data read with the document reading device 300 via e.g. a telephone line, and transmits data inputted from the data input terminal 20 via e.g. a telephone line.

In the image forming apparatus main body 30, a supply opening/closing part 80, used as an opening/closing part opened/closed to the side of the operation panel 700, is attached to a front side (left side in FIG. 2) surface. The supply opening/closing part 80 is attached using a hinge 86 so as to be opened/closed with respect to the image forming apparatus main body 30. Further, an opening 82 is formed toward the front side is formed in the supply opening/closing part 80. Further, a paper-feed opening/closing part 84 used as an opening/closing part opened/closed to the side of the operation panel 700 is attached in the image forming apparatus main body 30. The paper-feed opening/closing part 84 is attached to the image forming apparatus main body 30 using the hinge 86 as in the case of the supply opening/closing part 80. When the opening 82 of the supply opening/closing part 80 is opened/closed and the opening 82 is opened/closed, the front side of the image forming apparatus main body 30 is opened/closed.

As shown in FIG. 1, the both supply opening/closing part 80 and the paper-feed opening/closing part 84 can be closed with respect to the image forming apparatus main body 30. Further, as shown in FIG. 2, the supply opening/closing part 80 can be closed with respect to the image forming apparatus main body 30 and the paper-feed opening/closing part 84 can be opened with respect to the image forming apparatus main body 30 (also see FIG. 4). Further, the supply opening/closing part 80 and the paper-feed opening/closing part 84 can be integrally opened with respect to the image forming apparatus main body 30 (see FIG. 5).

As shown in FIG. 2, a rotation center 88 of the supply opening/closing part 80 and the paper-feed opening/closing part 84 is positioned on the center C2 side from a center C1 of the operation panel 700 in the image forming apparatus main body 30. Accordingly, in comparison with a case where the rotation center 88 is positioned on the opposite side to the center C2 side of the image forming apparatus main body 30 from the center C1 of the operation panel 700, or a case where the rotation center 88 is positioned so as to overlap the center C1 of the operation panel 700 in a vertical direction, the area of installation of the image forming apparatus 10 is reduced when the paper-feed opening/closing part 84 is opened and when the supply opening/closing part 80 and the paper-feed opening/closing part 84 are opened.

Further, in the image forming apparatus main body 30, an edge 39 of the bottom surface 38 on the operation panel 700 side is positioned on the center C2 side of the image forming apparatus main body 30 from the center C1 of the operation panel 700. Accordingly, in comparison with a case when the edge 39 is positioned on the opposite side to the center C2 side of the image forming apparatus main body 30 from the center C1 of the operation panel 700 or when the edge 39 is positioned to overlap the center C1 of the operation panel 700 in the vertical direction, the area of installation of the image forming apparatus 10 is reduced in a status where the supply opening/closing part 80 and the paper-feed opening/closing part 84 are closed.

Further, in the image forming apparatus main body 30, the area of the bottom surface 38 projected on a mounting surface 800 is smaller than the area of the upward surface 34 projected on a mounting surface 800. Accordingly, in comparison with a case when the area of the bottom surface 38 projected on the mounting surface 800 is larger than the area of the upward surface 34 projected on the mounting surface 800 or when the area of the upward surface 34 projected on the mounting surface 800 and the area of the bottom surface 38 projected on the mounting surface 800 are the same, the area of installation of the image forming apparatus 10 is reduced.

The data input terminal 20 is arranged in e.g. a front side surface of the image forming apparatus main body 30.

The image forming part 120 has a photoreceptor drum 122 used as an image holder, a charging device 124 to charge the surface of the photoreceptor drum 122, a latent image forming device 126 to form a latent image on the surface of the photoreceptor drum 122 by emitting light on the surface of the photoreceptor drum 122 charged with the charging device 124, a developing device 128 to develop the latent image formed with the latent image forming device 126 on the surface of the photoreceptor drum 122 using a developer, a transfer device 130 to transfer a developer image formed by development with the developing device 128 on the surface of the photoreceptor drum 122 to a print sheet, a cleaning device 132 to clean the developer remaining on the surface of the photoreceptor drum 122 after the transfer with the transfer device 130, and a fixing device 140 to fix the developer image, transferred to the sheet with the transfer device 130, to the sheet. A developer contained in a developer container 144 (see FIG. 5) to be described later is supplied to the developing device 128 using a developer conveyance device (not shown).

The paper feeding device 160 has e.g. one sheet container 162 and a feed roller 164 to feed a sheet contained in the sheet container 162. To set a print sheet in a predetermined or larger size in the sheet container 162, the paper-feed opening/closing part 84 is opened, and when such print sheet is set, the rear end side of the print sheet protrudes from the image forming apparatus main body 30, and the protruded part of the print sheet is supported with the paper-feed opening/closing part 84 from the lower side in the gravitational direction.

The conveyance passage 180 is used for conveyance of a print sheet from the paper feeding device 160 toward the transfer device 130, and for further conveyance of the print sheet to the discharge part 400. The above-described feed roller 164, a conveyance roller 182, a registration roller 184, the above-described transfer device 130, the above-described fixing device 140, and a discharge roller 186, are provided along the conveyance passage 180 sequentially from the upstream side in a print sheet conveyance direction.

The conveyance roller 182 conveys the print sheet toward the registration roller 184. The registration roller 184 temporarily stops movement of the end of the print sheet conveyed toward the transfer device 130, and restarts the movement of the end of the print sheet toward the transfer device 130 in accordance with the timing of arrival of the developer image formed on the photoreceptor drum 122 at the position of the transfer device 130. The discharge roller 186 conveys the print sheet on which the developer image has been fixed with the fixing device 140 toward the discharge part 400.

The document reading device 300, having a document reading device main body 302, is provided above the image forming apparatus main body 30 so as to form a space S between the document reading device 300 and the discharge part 400. Further, in the document reading device 300, a rear end side (right side end in FIG. 2) is attached openably/closably with respect to the image forming apparatus main body 30 using a hinge 304. Accordingly, the document reading device 300 is movable between a first position shown in FIG. 1 and FIG. 2 and a second position shown in FIG. 3. Note that the first position is a position where the document reading device 300 is supported with the upward surface 34 of the image forming apparatus main body 30 from a lower position. Further, the second position is a position where the space S is expanded in comparison with a case where the document reading device 300 is provided in the first position.

The discharge part 400 is provided in the upward surface 34 of the image forming apparatus main body 30. The discharge part 400 has an extension part 410 extendible from the surface 34 in a frontward direction in which the print sheet is discharged. The extension part 410 has a first extension member 414 extendible from the surface 34 in the print sheet discharge direction and a second extension member 420 extendible further frontward from the first extension member 414. The extension part 410 supports a part of a print sheet, on which an image has been formed, protruded from the surface 34, from the lower side in the gravitational direction.

The buffer device 500 is used for absorption of an impact due to rotation operation of the document reading device 300 about the hinge 304. The buffer device 500 is provided on the right side (front side in FIG. 3) of the image forming apparatus 10 and the left side (back side in FIG. 3) of the image forming apparatus 10. In FIG. 2, the one of these buffer devices 500, provided on the right side, is shown, and the buffer device provided on the left side is omitted. The buffer device 500 provided on the right side and the buffer device 500 provided on the left side have the same structure.

The buffer device 500 has an arm member 502, a guide member 510, and a coil spring 560. In the arm member 502, the side of an end 504 is attached via the guide member 510 to the document reading device 300, and the side of other end 506 is rotatably attached to the image forming apparatus main body 30. Further, the arm member 502 supports the document reading device 300 provided in the second position from a lower position. The guide member 510 which is a member to guide the arm member 502 is provided in the document reading device 300. The coil spring 560 is used as a pressing member to press the arm member 502.

The operation panel 700, having a push member pushed upon input of e.g. a destination facsimile transmission number, a push member pushed when starting image formation, and the like, is provided on the front side of the image forming apparatus 10. Further, the operation panel 700 is integrated with the document reading device 300. The operation panel 700 moves between the first position and the second position integrally with the document reading device 300.

Figure 4:
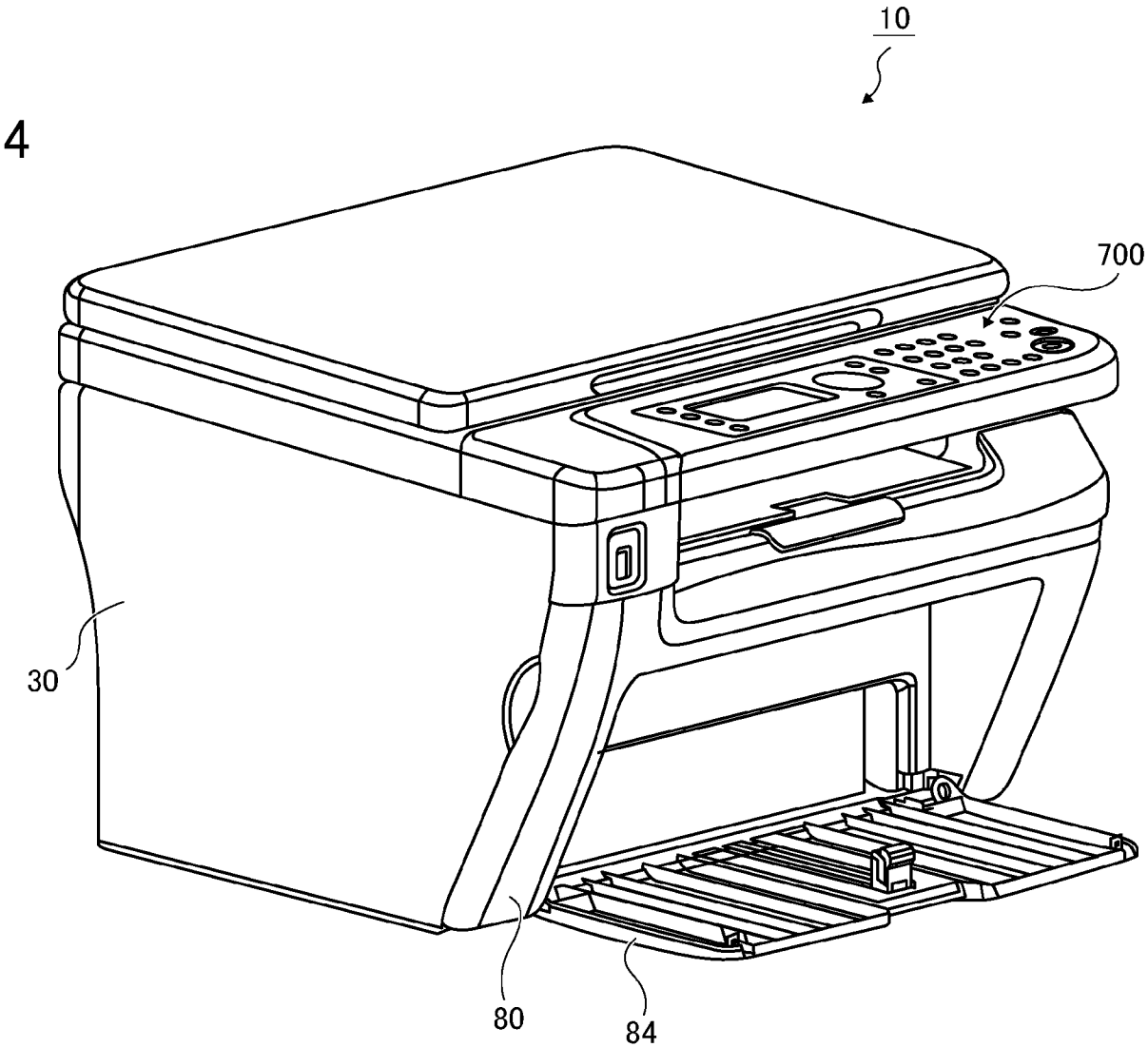
FIG. 4 is a perspective view showing the image forming apparatus in FIG. 1 in which a supply opening/closing part is closed and a paper-feed opening/closing part is opened.

FIG. 4 shows the image forming apparatus 10 when the supply opening/closing part 80 is closed with respect to the image forming apparatus main body 30 and the paper-feed opening/closing part 84 is opened with respect to the image forming apparatus main body 30. In this status, a print sheet is supplied on an upward surface of the paper-feed opening/closing part 84.

Figure 5:
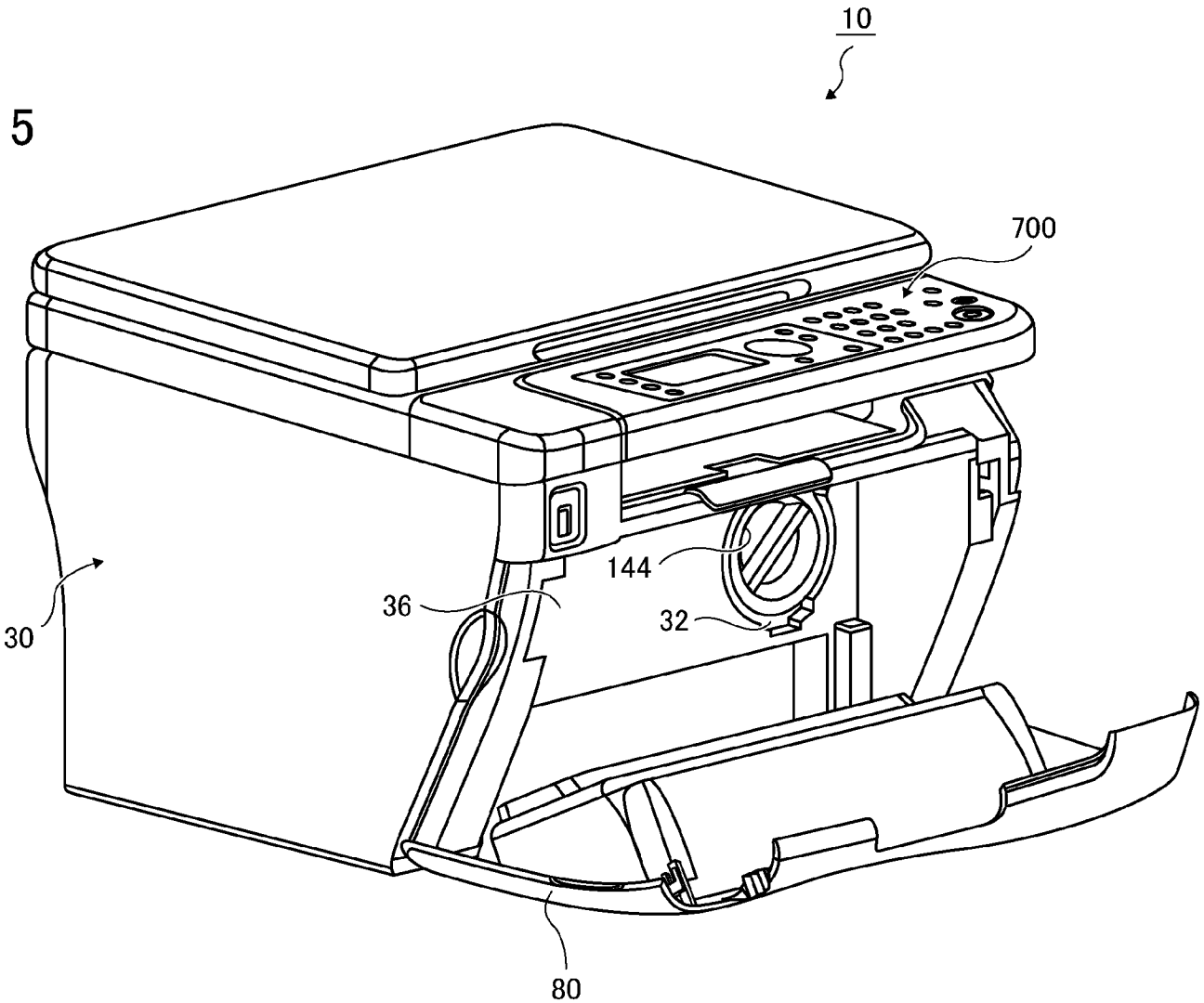
FIG. 5 is a perspective view of the image forming apparatus in FIG. 1 in which the supply opening/closing part and the paper-feed opening/closing part are integrally opened.

FIG. 5 shows a status where the supply opening/closing part 80 and the paper-feed opening/closing part 84 are integrally opened with respect to the image forming apparatus main body 30. A removable part 32 to/from which the developer container 144 is attached/removed is formed in a front side surface 36 of the image forming apparatus main body 30 exposed upon opening of the supply opening/closing part 80 and the paper-feed opening/closing part 84. When a new developer container 144 containing a sufficient amount of developer is attached to the removable part 32, the developer is supplied to the image forming apparatus 10. As described above, the developer such as toner contained in the developer container 144 is conveyed to the developing device 128 (see FIG. 2).

Figure 6:
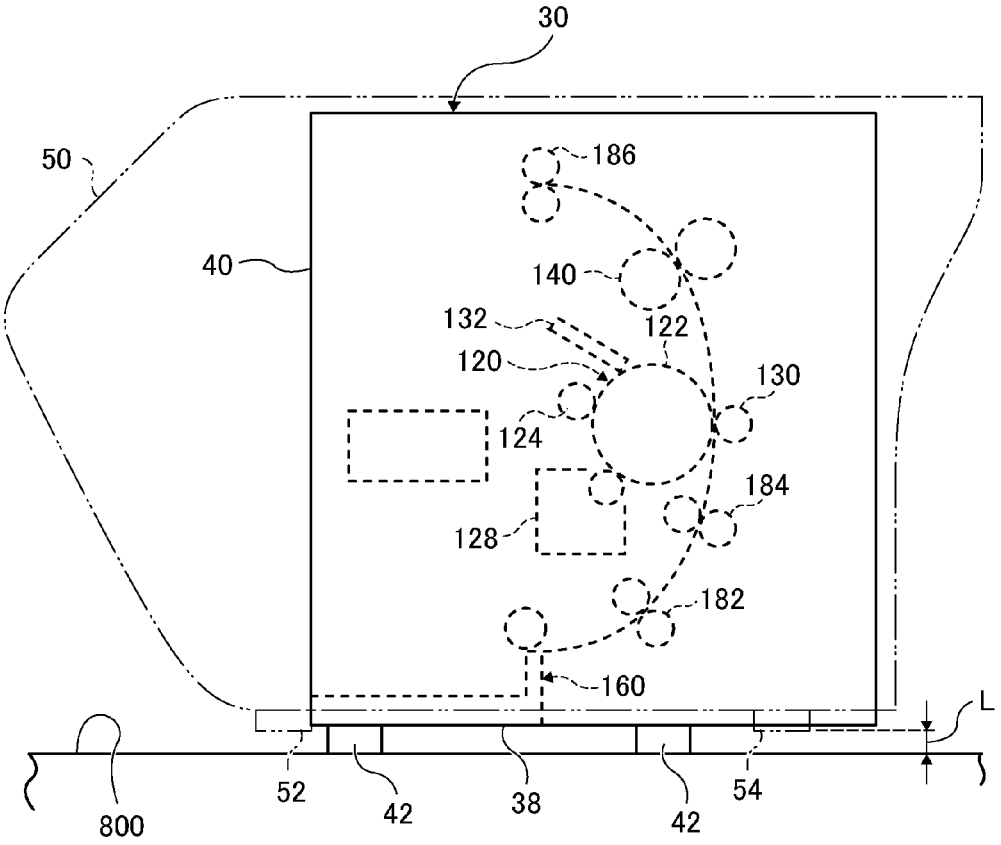
FIG. 6 is a cross-sectional view of an image forming apparatus main body of the image forming apparatus in FIG. 1 viewed from the right side surface.

FIG. 6 shows the image forming apparatus main body 30. As shown in FIG. 6, the image forming apparatus main body 30 has a main body frame 40 used as an attachment part to which the image forming part 120 is attached and an exterior cover 50 used as an exterior part arranged to cover the main body frame 40.

The main body frame 40 has e.g. a pair of opposite plate members of e.g. a metal material. Further, the photoreceptor drum 122, the charging device 124, the developing device 128, the transfer device 130, the cleaning device 132 and the fixing device 140 as constituent members of the image forming part 120 are attached to the main body frame 40. Further, the paper feeding device 160, the conveyance roller 182, the registration roller 184 and the discharge roller 186 are attached to the main body frame 40. Further, a drive source (not shown) such as a motor to drive the photoreceptor drum 122 or the like and a drive transmission mechanism (not shown) such as a gear array to transmit driving from the drive source to e.g. the photoreceptor drum 122, are attached to the main body frame 40.

Further, a support projection 42 is provided on the main body frame 40. The support projection 42 is provided on the bottom surface 38 of the image forming apparatus main body 30 and is used as a support part in contact with the mounting surface 800 to support the image forming apparatus main body 30. As the support projection 42, an elastic member of e.g. rubber is attached to the main body frame 40.

The exterior cover 50 which is made of e.g. resin is fixed to the main body frame 40 using e.g. a screw. Further, the exterior cover 50 supports the document reading device 300 and the operation panel 700 from the lower side in the gravitational direction. Further, the exterior cover 50 has a first convex part 52 and a second convex part 54. The first convex part 52 is used as a convex part formed on the bottom surface 38 of the image forming apparatus main body 30.

It may be arranged such that the first convex part 52 and the second convex part 54 are integrally formed with the exterior cover 50 or other members are attached to the exterior cover 50. When other members are attached to the exterior cover 50, elastic members of e.g. rubber may be used. Further, it may be arranged such that as the first convex part 52 and the second convex part 54, convex parts are integrally formed with the exterior cover 50 and other members are attached to the convex parts.

As shown in FIG. 6, the first convex part 52 is positioned on the operation panel 700 side from the image forming part 120.

As shown in FIG. 6, in a status where the image forming apparatus 10 is mounted on the mounting surface 800 and the respective support projections 42 are in contact with the mounting surface 800, the second convex part 54 forms a clearance L between the second convex part 54 and the mounting surface 800. Accordingly, in a normal status, the second convex part 54 is away from the mounting surface 800. On the other hand, when a force is applied to the rear side of the image forming apparatus main body 30 due to e.g. movement of the document reading device 300 with great force from the first position to the second position and the image forming apparatus main body 30 is inclined rearward, the second convex part 54 comes into contact with the mounting surface 800. Then, when the second convex part 54 is in contact with the mounting surface 800, the image forming apparatus main body 30 is prevented from being further inclined rearward from that status, thus overturning due to rearward inclination is prevented.

Figure 7:
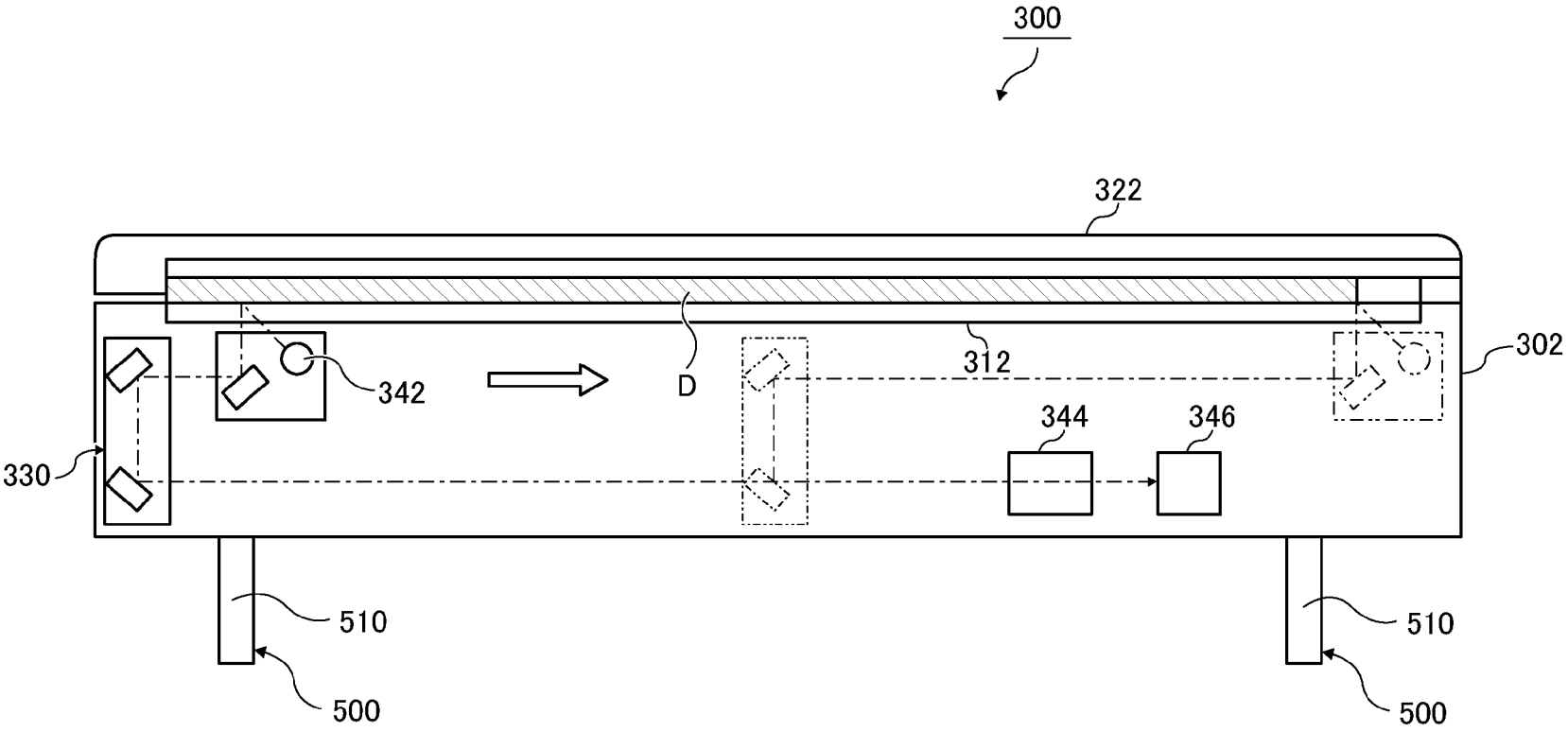
FIG. 7 is a cross-sectional view of an original reading device of the image forming apparatus in FIG. 1 along a line A-A in FIG. 2.

FIG. 7 shows the document reading device 300. As described above, the document reading device 300 has the document reading device main body 302, and the guide member 510 of the buffer device 500 positioned on the right side and the guide member 510 of the buffer device 500 positioned on the left side are attached to a downward surface of the document reading device main body 302. Further, the document reading device 300 has a platen member 312 of a light-transmitting material on which a document D is placed. Further, a platen cover 322 openable/closable with respect to the document reading device main body 302 is attached to the document reading device main body 302.

A reading part 330 to emit light to a document and read the document based on light reflected from the document is attached in the document reading device main body 302. The reading part 330 has a light source 342, a lens 344 and a photoelectric conversion element 346. The light source 342 emits light to the document D, reflected light is collected with the lens 344, and the collected light is received with the photoelectric conversion element 346 and is converted into a signal.

Figure 8:
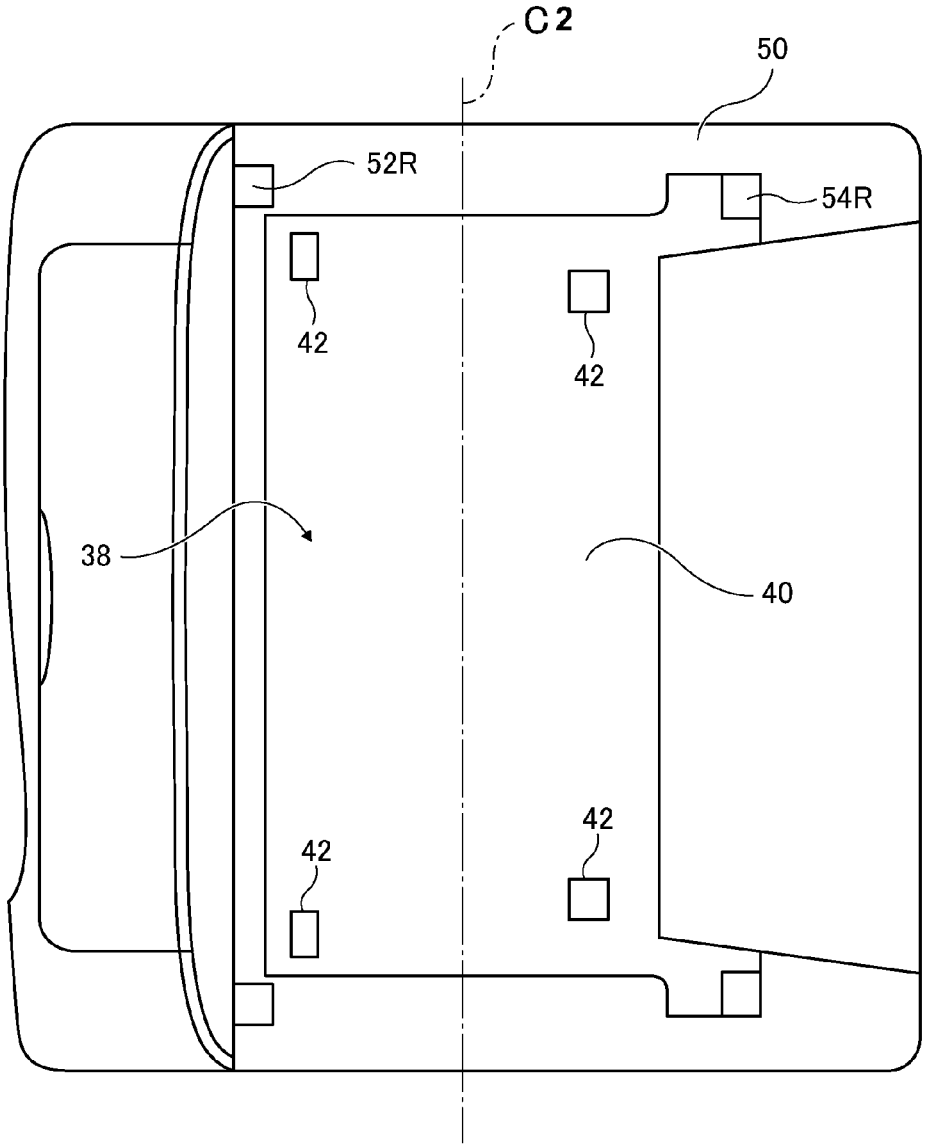
FIG. 8 is a bottom plan view of the image forming apparatus main body in FIG. 6.
Figure 9:
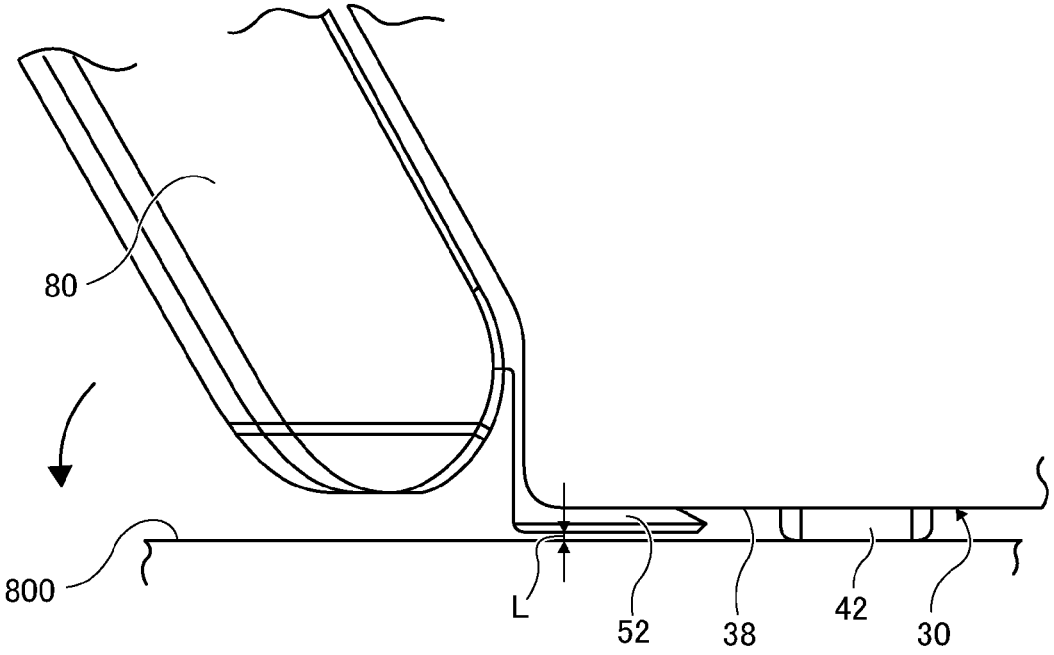
FIG. 9 is an enlarged view in the vicinity of a convex part of the image forming apparatus main body in FIG. 6.

FIG. 8 shows the bottom surface 38 of the image forming apparatus main body 30. FIG. 9 shows an enlarged view in the vicinity of the first convex part 52 of the image forming apparatus main body 30. As shown in FIG. 8, the above-described support projection 42 is provided in four positions of the main body frame 40. Further, as shown in FIG. 8, the above-described first convex part 52 is provided in two positions of the exterior cover 50. Hereinbelow, to distinguish the two first convex parts 52 from each other, the first convex part 52 positioned on the right side (upper side in FIG. 8) is referred to as a first convex part 52R, while the first convex part 52 positioned on the left side (lower side in FIG. 8), as a first convex part 52L. Further, as shown in FIG. 8, the above-described second convex part 54 is provided in two positions of the exterior cover 50. Hereinbelow, to distinguish the two second convex parts 54 from each other, the second convex part 54 positioned on the right side is referred to as a second convex part 54R, while the second convex part 54 positioned on the left side is referred to as a second convex part 54L.

As shown in FIG. 8, the first convex part 52 is provided on the operation panel 700 (see FIG. 1) side and on the front side (left side in FIG. 8) from the respective four support projections 42. Further, the first convex part 52R is positioned on the right side from any of the support projections 42, and the first convex part 52L is positioned on the left side from the any of the support projections 42. In this manner, any one of the first convex parts 52 is positioned on the outer side from the support projections 42 in the lengthwise direction of the operation panel 700. Further, the second convex parts 54 are provided on the hinge 304 (see FIG. 2) side and the rear side (right side in FIG. 8) from the respective four support projections 42. Further, the second convex part 54R is positioned on the right side from any of the support projections 42 and the second convex part 54L is positioned on the left side from any of the support projections 42. In this manner, any of the second convex parts 54 is positioned on the outer side from the support projections 42 in the lengthwise direction of the operation panel 700.

In this manner, since any of the second convex parts 54 is positioned on the outer side from the support projections 42 in the lengthwise direction of the operation panel 700, when the image forming apparatus main body 30 is inclined to the right side, the second convex part 54R comes into contact with the mounting surface 800. Then, when the second convex part 54R is in contact with the mounting surface 800, the image forming apparatus main body 30 is hardly inclined rightward from that status, and overturning due to rightward inclination is prevented. Further, when the image forming apparatus main body 30 is inclined to the left side, the second convex part 54L comes into contact with the mounting surface 800. Then when the second convex part 54L is in contact with the mounting surface 800, the image forming apparatus main body 30 is hardly inclined leftward from that status, and overturning due to leftward inclination is prevented.

As shown in FIG. 9, in a status where the image forming apparatus 10 is mounted on the mounting surface 800 and the respective support projections 42 are in contact with the mounting surface 800, the first convex part 52 forms a clearance L between the first convex part 52 and the mounting surface 800. The clearance L is e.g. 0.5 mm. Since the clearance L is formed, in a normal status, the first convex part 52 is away from the mounting surface 800. On the other hand, when the image forming apparatus main body 30 is inclined frontward as indicated with an arrow in FIG. 9 due to e.g. application of a downward force to the operation panel 700 for operation of the operation panel 700 (see FIG. 1), the first convex part 52 comes into contact with the mounting surface 800. When the first convex part 52 is in contact with the mounting surface 800, the image forming apparatus main body 30 is hardly inclined frontward from that status, thus overturning due to frontward inclination is prevented.

Further, as described above, any of the first convex parts 52 is provided on the outer side from the support projections 42 in the lengthwise direction of the operation panel 700. Accordingly, when the image forming apparatus main body 30 is inclined to the right side due to e.g. application of a downward force to the operation panel 700, the first convex part 52R comes into contact with the mounting surface 800. Then, when the first convex part 52R is in contact with the mounting surface 800, the image forming apparatus main body 30 is hardly inclined rightward from that status, thus overturning due to rightward inclination is prevented. Further, when the image forming apparatus main body 30 is inclined to the left side, the first convex part 52L comes into contact with the mounting surface 800. Then, when the first convex part 52L is in contact with the mounting surface 800, the image forming apparatus main body 30 is hardly inclined leftward from that status, and overturning due to leftward inclination is prevented.

As described above, the present invention is applicable to an image forming apparatus such as a copier, a facsimile machine and a printer.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body;

an image forming part provided in the image forming apparatus main body, to form an image on a recording medium;

an operation part configured to operate the image forming apparatus;

a support part provided on a bottom surface of the image forming apparatus main body and in contact with a mounting surface for the image forming apparatus main body to support the image forming apparatus main body; and a convex part provided on the bottom surface, wherein the convex part being provided on the operation part side from the support part, and is configured to form a clearance between the convex part and the mounting surface in response to no inclination of the image forming apparatus, and wherein the convex part is configured to contact the mounting surface in response to inclination of the image forming apparatus.

2. The image forming apparatus according to claim 1, wherein an edge of the bottom surface on the operation part side is positioned between a center of the image forming apparatus main body and a center of the operation part.

3. The image forming apparatus according to claim 1, further comprising an opening/closing part attached to the image forming apparatus main body and opened to the operation part side, wherein a rotational center of the opening/closing part is positioned between a center of the image forming apparatus main body and a center of the operation part.

4. The image forming apparatus according to claim 1, wherein the convex part is positioned on the operation part side from the image forming part.

5. The image forming apparatus according to claim 1, wherein the image forming apparatus main body comprises:

an attachment part to which the image forming part is attached; and an exterior part arranged to support the operation part and cover the support part, and the convex part is provided on the exterior part.

6. The image forming apparatus according to claim 1, wherein the convex part is positioned on an outer side from the support part in a lengthwise direction of the operation part.

7. The image forming apparatus according to claim 1, wherein in the image forming apparatus main body, the bottom surface is smaller than an upper side surface of the image forming apparatus main body.

8. The image forming apparatus according to claim 1, wherein the convex part comprises a plurality of convex parts and the support part comprises a plurality of support parts, and wherein the plurality of convex parts are disposed apart from the plurality of support parts toward outer-most edges of the bottom surface in a length-wise direction and a width-wise direction, wherein the length-wise direction and the widthwise direction are perpendicular from each other and are perpendicular from the gravitational direction.

9. The image forming apparatus according to claim 1, further comprising a document reading device which is provided above the image forming apparatus main body, wherein the document reading device is movable with respect to the image forming apparatus to rotate around a rotational center which is provided at a rear end of the image forming apparatus main body, wherein the convex part comprises a plurality of convex parts, and wherein at least one convex part is provided rear side from the support part.

10. The image forming apparatus according to claim 9, wherein the document reading device comprises a reading part, and wherein the reading part moves with respect to the image forming apparatus main body in association with the movement of the document reading device with respect to the image forming apparatus main body.

11. The image forming apparatus according to claim 1, wherein the convex part comprises a plurality of convex parts and the support part comprises a plurality of support parts, and wherein the plurality of convex parts are provided outside a region surrounded by the plurality of support parts.

* * * * *